US006994043B1

(12) United States Patent
Price

(10) Patent No.: US 6,994,043 B1
(45) Date of Patent: Feb. 7, 2006

(54) METHOD OF FORMING A MATTRESS

(75) Inventor: Elvin C. Price, Dacula, GA (US)

(73) Assignee: Atlanta Attachment Company, Lawrenceville, GA (US)

( * ) Notice: Subject to any disclaimer, the term of this patent is extended or adjusted under 35 U.S.C. 154(b) by 0 days.

(21) Appl. No.: 10/848,787

(22) Filed: May 19, 2004

Related U.S. Application Data

(60) Provisional application No. 60/471,825, filed on May 20, 2003, provisional application No. 60/478,482, filed on Jun. 13, 2003, provisional application No. 60/483,718, filed on Jun. 30, 2003.

(51) Int. Cl.
*D05B 11/00* (2006.01)

(52) U.S. Cl. ..... 112/475.08; 112/2.1

(58) Field of Classification Search ..... 112/132, 112/2.1, 147, 152, 153, 136, 475.06, 475.08, 112/475.03, 475.04; 5/717
See application file for complete search history.

(56) References Cited

U.S. PATENT DOCUMENTS

| | | | | |
|---|---|---|---|---|
| 1,947,058 A | | 2/1934 | Pittoni | 112/3 |
| 3,173,159 A | * | 3/1965 | Hart | 5/717 |
| 3,490,061 A | | 1/1970 | Docker | 112/2.1 |
| 3,673,906 A | | 7/1972 | Cash | 83/208 |
| 4,019,447 A | | 4/1977 | Blessing et al. | 112/121.11 |
| 4,019,451 A | * | 4/1977 | Autrey | 112/475.08 |
| 4,043,282 A | | 8/1977 | Fanghanel | 112/3 |
| 4,117,790 A | | 10/1978 | Hasegawa et al. | 112/309 |
| 4,181,085 A | | 1/1980 | Conner, Jr. | 112/121.12 |
| 4,290,376 A | | 9/1981 | Brusasca | 112/121.26 |
| 4,424,600 A | | 1/1984 | Callaway | |
| 4,462,129 A | | 7/1984 | Brannock | 5/474 |
| 4,498,404 A | | 2/1985 | Sadeh | 112/121.12 |
| 4,691,651 A | | 9/1987 | Junemann | 112/259 |
| 4,703,706 A | | 11/1987 | Plante | 112/265.1 |
| 4,742,789 A | | 5/1988 | Pestel et al. | 112/262.3 |
| 4,776,579 A | | 10/1988 | Romand et al. | 271/228 |
| 4,794,873 A | | 1/1989 | Dordi et al. | 112/2.1 |
| 4,813,364 A | | 3/1989 | Boser | 112/304 |
| 4,821,656 A | | 4/1989 | Dordi et al. | 112/2.1 |
| 4,825,787 A | | 5/1989 | Babson et al. | 112/262.3 |
| 4,827,856 A | | 5/1989 | Rohr | 112/63 |
| 5,018,462 A | | 5/1991 | Brocklehurst | 112/121.12 |
| 5,145,144 A | | 9/1992 | Resta et al. | 248/637 |
| 5,185,897 A | | 2/1993 | Van Laanen | 5/455 |

(Continued)

FOREIGN PATENT DOCUMENTS

DE 31 39426 A1 4/1983

(Continued)

OTHER PUBLICATIONS

Yamaichi, Tape binding and sewing Robot System, Y&Y-RB-A System.

*Primary Examiner*—Ismael Izaguirre
(74) *Attorney, Agent, or Firm*—Womble Carlyle Sandridge & Rice, PLLC

(57) ABSTRACT

A method of forming a mattress, with a reduction in the number of sewing operations required, in which a border and gusset or an extended portion of the border will be integrally formed and attached to a mattress panel, with a flanging material also being attached as needed, to form a mattress cover or sleeve. A tape edge also can be applied for providing a more decorative appearance. Thereafter, the mattress cover or sleeve can be applied over a mattress spring set.

23 Claims, 9 Drawing Sheets

U.S. PATENT DOCUMENTS

| | | | | |
|---|---|---|---|---|
| 5,367,968 | A | 11/1994 | Diaz | 112/262.3 |
| 5,428,852 | A | 7/1995 | Tenuta et al. | |
| 5,475,881 | A | 12/1995 | Higgins et al. | |
| 5,483,909 | A | 1/1996 | Nogueras | 112/475.04 |
| 5,515,796 | A | 5/1996 | Ogle et al. | 112/2.1 |
| 5,529,004 | A | 6/1996 | Porter et al. | 112/470.03 |
| 5,537,699 | A | 7/1996 | Bonaddio et al. | 54/474 |
| 5,542,775 | A | 8/1996 | Bechtoldt et al. | |
| 5,560,308 | A | 10/1996 | Eto | 112/470.07 |
| 5,586,511 | A | 12/1996 | Porter et al. | 112/2.1 |
| 5,617,802 | A | 4/1997 | Cash | 112/117 |
| 5,647,293 | A | 7/1997 | Price et al. | 112/470.17 |
| 5,701,623 | A | 12/1997 | May | |
| 5,809,919 | A | 9/1998 | Mitchell et al. | 112/470.07 |
| 5,881,656 | A | 3/1999 | Grant | 112/2.11 |
| 5,896,605 | A * | 4/1999 | Branman | 5/716 |
| 5,915,319 | A | 6/1999 | Price et al. | 112/470.16 |
| 5,943,971 | A | 8/1999 | Trickett et al. | 112/2.1 |
| 5,974,609 | A | 11/1999 | Nunez et al. | |
| 6,000,352 | A | 12/1999 | Porter et al. | 112/470.12 |
| 6,088,858 | A | 7/2000 | Juster et al. | |
| 6,125,488 | A | 10/2000 | Vogland et al. | |
| 6,202,579 | B1 | 3/2001 | Olewicz et al. | 112/2.1 |
| 6,209,468 | B1 | 4/2001 | Marcangelo et al. | 112/475.06 |
| 6,397,768 | B1 | 6/2002 | Dasher et al. | 112/2.11 |
| 6,408,773 | B2 * | 6/2002 | Resta | 112/2.1 |
| 6,574,815 | B2 | 6/2003 | Freeman et al. | |
| 6,648,585 | B2 | 11/2003 | Block et al. | 414/759 |
| 6,802,271 | B2 | 10/2004 | Oxley et al. | |
| 6,804,849 | B2 * | 10/2004 | Van Patten | 5/737 |
| 6,834,603 | B1 | 12/2004 | Ruderman et al. | |
| 2002/0050117 | A1 | 5/2002 | Dasher et al. | 53/117 |

FOREIGN PATENT DOCUMENTS

| | | |
|---|---|---|
| DE | 37 12493 A1 | 5/1987 |
| EP | 0264 618 A1 | 4/1988 |
| EP | 0 330 285 B1 | 2/1989 |
| EP | 0 200 368 B1 | 10/1990 |
| EP | 0682135 | 11/1995 |
| FR | 1567893 | 9/1967 |
| GB | 1233945 | 6/1971 |
| GB | 1384073 | 2/1975 |
| JP | 7308465 | 11/1995 |
| WO | WO 92/12282 | 7/1992 |
| WO | WO 95/25194 | 9/1995 |

* cited by examiner

METHOD OF FORMING A MATTRESS

CROSS REFERENCE TO RELATED APPLICATIONS

The present patent application is a formalization of a previously filed, now abandoned U.S. Provisional Application Ser. No. 60/471,825, filed May 20, 2003; to U.S. Provisional Application Ser. No. 60/478,482, filed Jun. 13, 2003; and to U.S. Provisional Application Ser. No. 60/483,718, filed Jun. 30, 2003 by the inventor named in this patent application. This patent application claims the benefit of the filing date of the cited provisional patent applications according to the statutes and rules governing provisional patent applications, particularly 35 USC § 119(e)(1) and 37 CFR §§ 1.78(a)(4) and (a)(5). The specification and drawings of the provisional patent applications are specifically incorporated herein by reference.

FIELD OF THE INVENTION

The present invention generally relates to sewing systems and methods for forming mattresses, and in particular, to a method of forming and attaching a top panel and/or border of a mattress to a flanging material for attachment of the mattress top to a spring set.

BACKGROUND OF THE INVENTION

In the textile field, most sewing operations traditionally have been extremely labor intensive, manual operations that generally have required skilled workers for cutting, sewing, and finishing textile articles. The more labor intensive the sewing operation and the greater the skill required of the operator to form the article, the greater the cost and slower the production of such articles. For example, in the manufacture of mattresses, and especially when forming a pillow top mattress, a top panel that includes a foam or cushion material is sewn to a flanging material, after which it is applied over a spring set for the mattress, with the flanging material being pulled down over the side edge of the spring set and hog ringed or stapled to a spring to secure the top panel of the mattress thereto. A border is then typically attached about the sides of the mattress, covering the flanging material and springs. Further, the upper panels and pillowtops of mattresses generally must be sewn or attached to the mattress border, pillowtop attachment gusset, and possibly a flanging material, by a tape edge, which is applied along the mating edges or seams therebetween by a tape edge applicator. The operation of such tape edge applicators generally requires significant skill and is a somewhat time consuming process. For continental type foundation or mattress borders, the borders generally will have a portion that will be folded flat over the top panel and mitered or ruffled along the corners thereof so as to have rounded or smooth corners that fit over the spring set or foundation. However, for a more decorative or finished appearance, it often is desirable to form a bead or seam at the point of connection between the inner panel and the border, which consequently requires further sewing operations.

Currently, there exist automated systems that enable workers to measure, cut and sew borders, attachment gussets, and other parts of a mattress or foundation. A drawback of such automated equipment is that it typically has been limited in the type and number of sewing operations that can be performed, while other operations, such as applying tape edges about the borders and pillowtops of mattresses still require significant skill and manual control by an operator to be performed. As a consequence, while various ones of the components of a mattress or box springs can be formed at increased rates, the final assembly of the mattress or box springs generally is still limited by more labor intensive, manual operations.

For example, FIGS. 1A–1B illustrate such a conventional method of assembling the mattress using a standard 4–5 thread safety stitch method and system. As indicated in FIG. 1A, the edges of the flanging material and top panel of the mattress generally are sewn with two to three lines of overlock stitches using an overlock sewing machine that sews and trims along the edges of the panel and flanging material. An additional one or two lines of overlock safety stitches also generally are applied one to two inches from the edge of the mattress panel to secure the flanging material to the bottom of the mattress panel, while at the same time, ensuring sufficient clearance from the edge so as to not interfere with the application of a tape edge in a later sewing operation.

In addition to the number of sewing operations performed, applying lines of overlock stitching to pillowtop type mattresses also typically requires a significant amount of pressure applied to the presser foot in order to compress or crush the foam or cushion material of the top panel sufficiently for sewing, especially if the top panel is exceptionally thick, i.e., six inches or more, to enable the loopers of the sewing machine to engage the sewing needles as the sewing needles penetrate the plies of material of the top panel. As a result, the increased pressure applied to compress this cushion material also bears against the feed dogs below the presser foot, potentially to the point of interfering with the operation of the presser foot and feed dogs in pulling the material through the sewing machine as the top panel is sewn to its flange.

Accordingly, it can be seen that a need exists for a system and method for forming a mattress that addresses the foregoing related and unrelated problems in the art.

SUMMARY OF THE INVENTION

Briefly described, the present invention generally relates to systems and methods for forming mattresses, including pillowtop, continental, Euro-top and other style mattresses, with the number of sewing operations required to form or construct the mattress being minimized. In a first embodiment of the invention, a border material, which typically is formed with an extended size or width, will be folded over along a fold line or seam so as to define a first or lower border portion and a second, extended or upper border portion. The second, extended border portion can be formed from a length sufficient to form an attachment gusset for attaching a top panel for a pillowtop mattress, although the size or width of the second, extended border portion can be varied as needed or desired. Typically, a flanging material thereafter will be applied to the border material.

The flanging material can be applied along the first or lower border portion, with one edge thereof substantially matched with the fold formed in the border, after which the border and flanging material will be secured to an inner panel for the mattress by the application of one or more lines of stitching adjacent the fold in the border. The flanging material also can be placed between the inner panel and the first border portion, with the side edges of the flange and inner panel being substantially matched with the fold in the border. Thereafter, for pillowtop-type mattresses, the first and second border portions, flanging material and inner panel of the mattress typically can be attached together in a single sewing operation through the application of one or more lines of stitching applied adjacent the fold of the border and side edges of the flanging material and inner panel.

Alternatively, for continental and other style mattresses in which the inner panel will be offset inwardly from the border of the mattress, the flanging material typically will be placed between the first and second folded portions of the border with its side edge projecting into the fold. Thereafter, the folded border and flanging material can be sewn together in one operation with one or more lines of stitching applied adjacent the fold. In addition, the line or lines of stitching can be applied at a predetermined location or point spaced from the fold of the border so as to define or form a decorative bead or rounded edge that typically will form the upper side edges of the resultant mattress. As a further alternative, a binding tape can be applied over the fold and attached in the same operation as the application of the one or more lines of stitching to secure the flanging material and border together, but without requiring the use of a conventional tape edge machine or highly skilled operators to perform such sewing operations. The inner panel of the mattress further can be attached to the side edge of the second or upper border portion in the same or in a second, downstream sewing operation.

As a result, a mattress cover or cap is formed, which cap can be formed in substantially uniform sizes so as to match spring sets or existing standard size mattresses, such as twin, double, queen or king sized mattresses. Thereafter, the mattress cover or cap will be applied over the spring set with the flanging material being secured to one or more springs of the spring set of the mattress such as by stapling, hog ringing or other suitable means. A bottom panel then can be applied to the lower or free end of the first border portion, such as with the first border portion being folded under the spring set and sewn to the bottom panel to complete the formation of the mattress.

In an additional embodiment of the present invention, such as for use in forming pillowtop-type mattresses in which the top panel of a mattress includes a cushion material applied between upper and lower layers of the panel, a flanging material can be additionally applied to the top panel for the mattress prior to or in conjunction with the application of the border material thereto. In this embodiment, the flanging material generally will be attached to the top panel at a sewing station, such as a chain stitch or bottom cover sewing station, with at least two lines of stitching applied to secure the flanging material to the side edges of the top panel. In one example embodiment, three lines of chain stitches will be applied with one of the lines applied at a position spaced inwardly from the side edges of the flanging material and top panel. Alternatively, a bead of glue can be applied between the flanging material and top panel, replacing the third, inwardly spaced line of chain stitches. The bead of glue will help hold the flanging material to the top panel and eliminate an additional seam to further provide the top panel mattress with a smooth, plain finished appearance. Still further, it is also possible to replace all the lines of chain stitching with the bead of glue and two lines of NDL bottom cover stitches applied adjacent the edges of the flanging material and top panel.

After the top panel and flanging material have been secured together, the top panel and flanging material will be attached to a border, which typically will have been folded to form or define a first, or lower portion of a border, or second, extended or upper portion of the border. The top panel and flanging material generally will be attached to the upper or extended portion of the border, with the flanging material sandwiched between the top panel and second or extended portion of the border. Typically, a binding tape will be applied over the attached edges of the top panel, flanging material and second portion of the border. A top panel, flanging material and border then will be applied over the spring set of a mattress with a bottom panel applied to the lower or free end of the first or lower portion of the border to complete the formation of the mattress.

Various objects, features, and advantages of the present invention will become apparent to those skilled in the art upon a review of the following specification if taken in conjunction with the accompanying drawings.

DETAILED DESCRIPTION OF THE INVENTION

Referring now in greater detail to the drawings in which like numerals indicate like parts throughout the several views, various example and alternative embodiments of the method for forming a mattress according to the principles of the present invention are illustrated. In general, the present invention is directed to a method of forming a mattress in which the number of sewing operations and skill of the operator(s) required to form a mattress are reduced or otherwise minimized to enable faster and more efficient production of mattresses using less skilled workers.

Figure 2A:
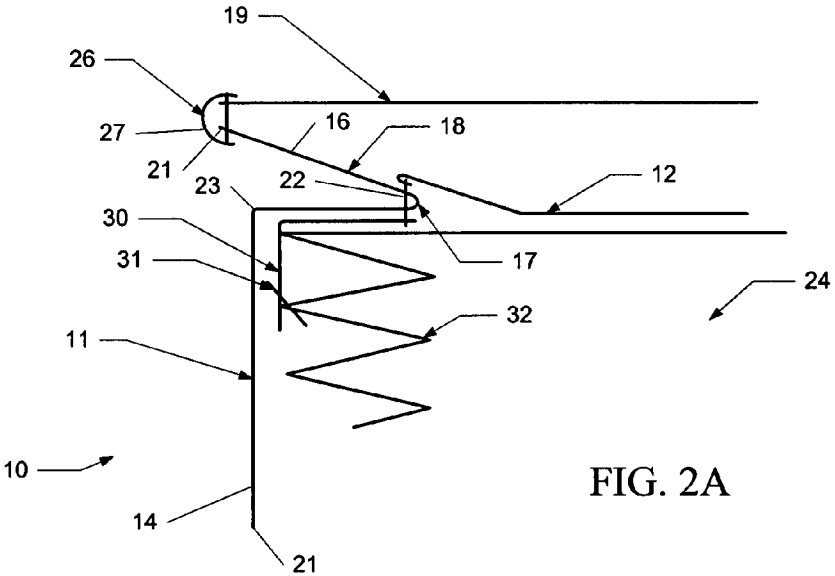
FIG. 2A is a schematic illustration showing the construction of a pillowtop mattress with the border and pillowtop attachment gusset formed according to one embodiment of the present invention.

In a first embodiment of the present invention, as generally illustrated in FIGS. 2A–6B, the present invention relates to a sewing system and method of forming a mattress 10, in which a mattress border 11 is formed and attached to an inner panel 12 along the side edges or periphery 13 of the panel. As indicated in FIGS. 2A–5B, the border 11 generally is formed from a woven or non-woven textile or fabric material and can include a decorative pattern or appearance, while the inner panel 12 generally is formed from a non-woven fabric material as is commonly used. The border 11 typically is of a width or size so as to define a first or lower portion 14 that generally is the size or width of a standard border, depending on the size mattress being formed (such as a king, queen, double or twin), and a second, extended or upper border portion 16 of a desired size or width when a fold or seam 17 is formed in the border, as indicated in FIGS. 2A, 3A, 4B, and 5B. For example, the second extended border portion 16 can be formed so as to function as an attachment gusset 18 (FIGS. 2A and 3A) integrally formed with its border for attaching a pillowtop 19 of a pillowtop mattress to the border and inner panel as shown in FIGS. 2A and 3A. This method can be performed at a single border formation and attachment workstation, such as disclosed and illustrated in Applicant's co-pending U.S. patent application Ser. No. 10/774,035, filed Feb. 6, 2004, the disclosure of which is incorporated herein by reference in its entirety. As generally shown in FIGS. 2A–5B, following the method of the present invention, the borders 11 formed and attached to the inner panels 12 can be continental style borders for pillowtop, plain, or other type mattresses, although other types of borders and/or mattresses also can be formed.

Figure 3A:
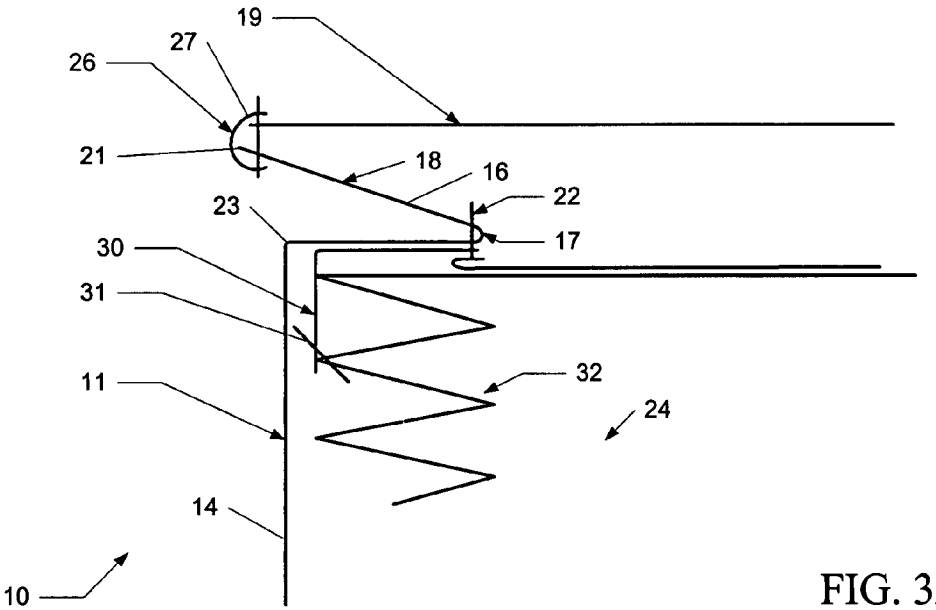
FIG. 3A is a schematic illustration of the border with a pillowtop attachment gusset and flanging material formed and attached to a mattress panel and mounted on a spring set for a mattress according to an additional embodiment of the present invention.

Typically, a length of border material 11 will be fed from a supply into a sewing station, such as an Atlanta Attachment Company. Inc. Model 1349, Automatic One-Piece Border Workstation (not shown). The border material initially can be passed through a hemmer, which will hem one or more of the side edges 21 of the border 11. The hemmed edge(s) of the border generally will be folded over or under the border along the fold or seam 17 so as to form or define the extended portion or attachment gusset. Thereafter, the border and inner panel 12 will be sewn together along the peripheral edges 13 of the panel 12 with the application of one or more lines of stitching 22 at the border attachment workstation. In addition, the border can be engaged by a ruffler mechanism of the workstation so as to form a series of ruffles or pleats 20 (FIG. 6B) in the border and gusset as it is being sewn about the corners of the associated inner panel. The resultant inner panel and border thus are formed with rounded corners 23 (FIGS. 6A–6B) that fit more closely about the spring set 24 of the mattress 10. The free ends then will be closed or attached together to complete the sewing operation at the border sewing station, although this can also be done in an additional operation and/or at a separate downstream station. Thereafter, as indicated in FIGS. 2A and 3A, the pillowtop 19 will be attached to the edges of the attachment gusset along seam 26, typically by application of a tape edge 27 covering the seam, to complete the formation of the pillowtop mattress.

As a result, the border and an attachment gusset for a pillowtop mattress generally will be formed from a single piece or sheet of border material, which enables the border and gusset material to be matched in appearance/design and material, and further eliminates the additional step of attaching a separately formed pillowtop attachment gusset to the border, and at substantially the same time, will be attached to the inner panel and a top panel or pillowtop in a reduced number, and potentially single sewing operation for forming a pillowtop mattress. As a further consequence, the seam created for such attachment of the pillowtop attachment gusset to the border likewise is avoided.

Utilizing the method and system of the present invention, the attachment of the pillowtop 19 to its attachment gusset 16 accordingly can be performed at either the same border sewing station or at an adjacent work table, or can be sewn or attached to the attachment gusset at a conventional binding station (not shown), rather than at a tape edge applicator station as currently done. As a further consequence, since there are no additional seams or edges other than the edges along which the pillowtop is attached to the attachment gusset, there is essentially only one seam 26 that is required to be tape-edged or sealed as shown at 27 in FIGS. 2B and 3B, which can be done using a conventional binding system or machine that can apply a tape edge about the seam between the attachment gusset and pillowtop since there is no further seam between the attachment gusset and border that must be matched and/or sewn similar to the tape edge.

Still further, the elimination of additional seams between the attachment gusset and its mattress border not only reduces the need for tape edging at such seams, but further helps reduce the amount and areas where the use of Kevlar threads and other fire resistant materials in order to meet fire standards for mattresses set by various states such as California. Since the seams are typically the initial point in which a mattress will catch on fire, a number of regulations have been enacted in various states that require the use of fireproof material such as Kevlar threads or bindings such as tape edges along such seams to resist their catching fire. Since Kevlar thread is extremely expensive and tends to abrade sewing needles and equipment rapidly, the use of the method of the present invention reduces the amount of Kevlar thread and other fire resistant materials that are required to form a mattress, since there is now only one seam (i.e., the seam between the attachment gusset and mattress panel) that is exposed and therefore must be fireproofed, and thus helps reduce the overall cost of the mattress.

Figure 2B:
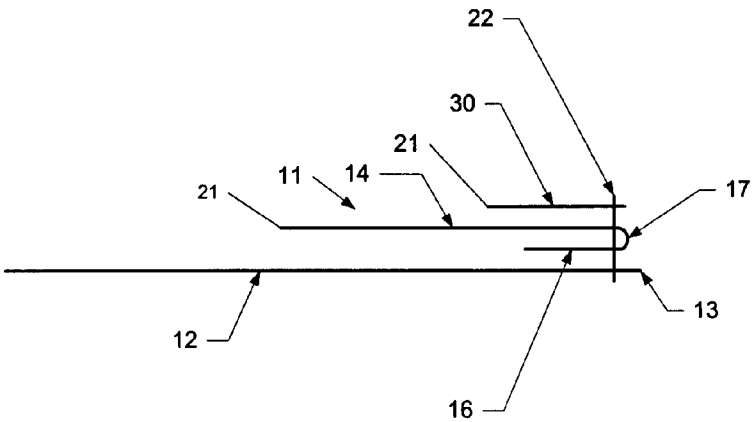
FIG. 2B is a schematic illustration showing the border with a pillowtop attachment gusset attached to a mattress panel and flanging material according to the embodiment of FIG. 2A.

As further illustrated in FIGS. 2A–5B, a flanging material 30 also can be applied to the border, such as along or over the first portion 14 of the border 11 as shown in FIG. 2B. Alternatively, the flanging material 30 can be placed between the first portion 14 of the border and the inner panel 12 as shown in FIG. 3B; or between the first and second portions 14 and 16 of the border as shown in FIGS. 4A–5B. The flanging material generally will be of a similar material to the inner panel 12 and typically will be attached to the border and inner panel by the same line of stitching 22 (FIGS. 2A–5B) applied along the fold or seam 17 of the border to attach the mattress panel 12 to the border as indicated in FIGS. 2B and 3B, and further can be applied as the side edge 21 of the border is hemmed. The flanging material generally will be used to help secure the border 11 with extended portion 16 or pillowtop attachment gusset and the inner panel 12 attached therewith to the spring set 24 (FIGS. 2A and 3A) of the mattress 10, such as by attaching the flanging material with a hog ring or staple 31 to an inner spring 32 of the spring set 24 as shown in FIGS. 2A and 3A.

Figure 6A:
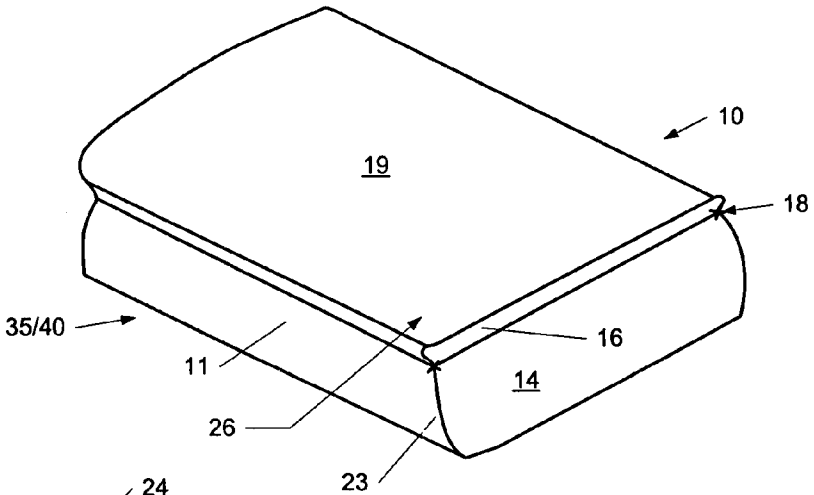
FIG. 6A a perspective illustration of a mattress cover having a border with a pillowtop attachment gusset and pillowtop according to the method of the present invention.
Figure 6B:
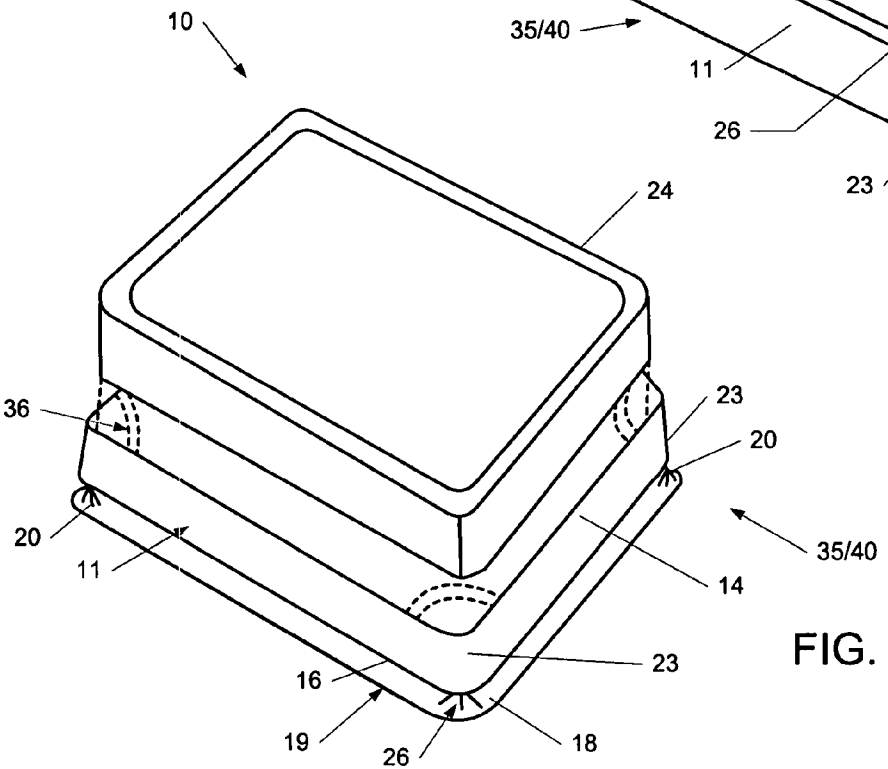
FIG. 6B is a perspective illustration generally illustrating the attachment or assembly of the mattress cover having a continental style border with pillowtop attachment gusset and pillowtop attached thereto as it is applied or assembled on the spring set of a mattress.

Accordingly, the resultant border 11 and mattress panel 12, with the pillowtop 19 attached thereto, forms a cover, cap or sleeve 35 (FIGS. 6A–6B) that can be applied over a spring set 24 as indicated in FIG. 6B, which can be manufactured and stockpiled and inventoried separately. Additionally, such mattress covers can be sold as a separate unit or piece that can be attached to a consumer's existing mattress to provide them with a new pillowtop mattress top such as for hotels, etc., without their having to buy completely new mattresses. The attachment of the pillowtop mattress cover 35 to a mattress or spring set is generally shown in FIG. 6B and can be done with conventional means such as folding over the edges of the mattress border and stapling or otherwise fastening these edges along the bottom surface of the spring set or by elastic bands (shown in phantom lines 36 in FIG. 6B) to enable releasable attachment of the mattress cover from a mattress spring set. Still further, other attachment mechanisms such as hook and loop fasteners (Velcro), hooks and eyelets or other releasably attachable means can also be used.

Figure 3B:
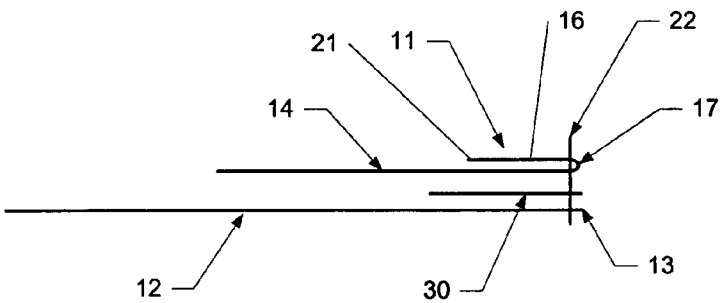
FIG. 3B is a schematic illustration of a mattress panel showing the attachment of a border with a pillowtop attachment gusset and flanging material to a mattress panel according to the embodiment of FIG. 3A.
Figure 4A:
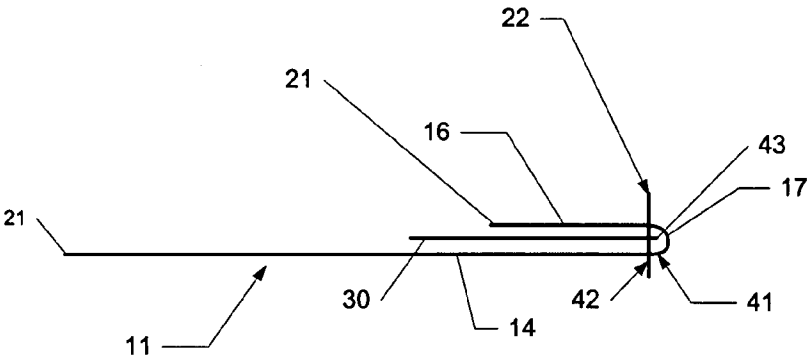
FIG. 4A is a side elevational view of another embodiment of the present invention, schematically illustrating the formation of the border with attached flange material for a mattress, with a decorative bead being formed.
Figure 4B:
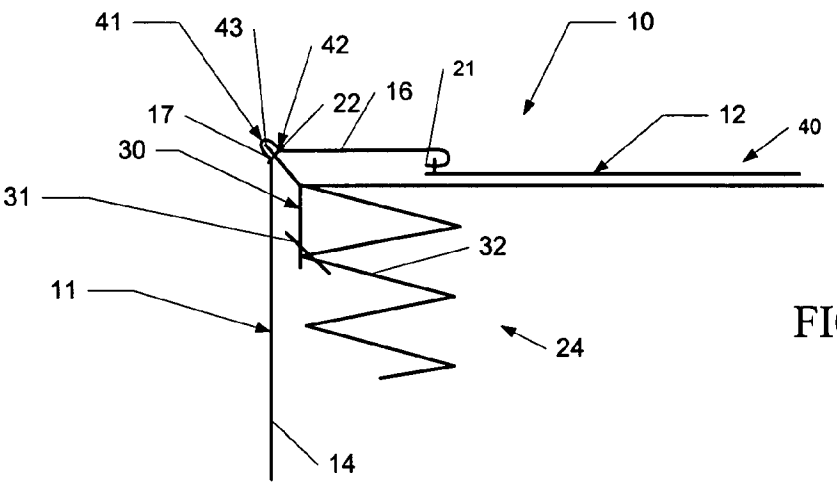
FIG. 4B is a side elevational view illustrating the attachment of the border material with decorative bead of FIG. 4A to a foundation or spring set.
Figure 5A:
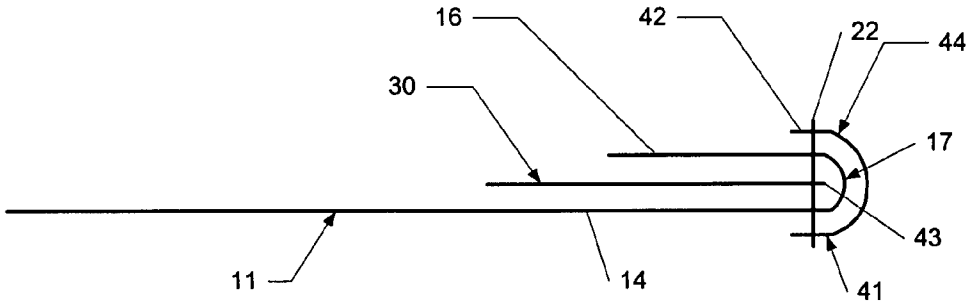
FIG. 5A is a side elevational view of another additional embodiment of the present invention for forming a mattress having a border with a flanging material attached thereto and bound with a binding tape to form a decorative bead.
Figure 5B:
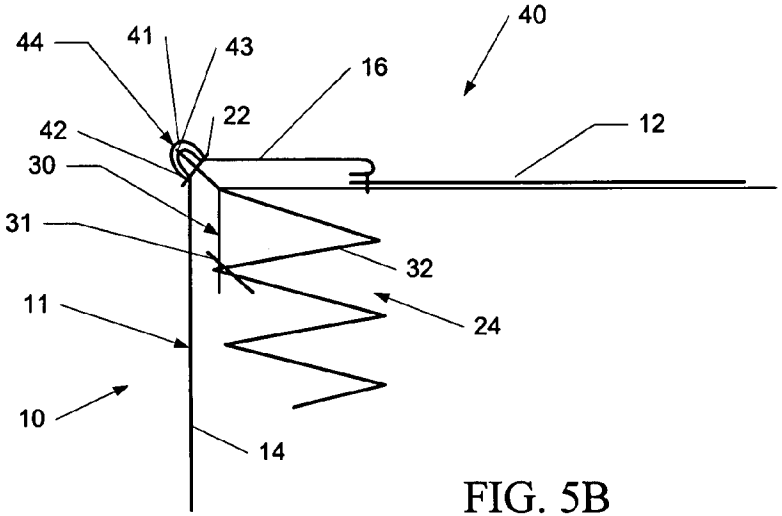
FIG. 5B is a side elevational view illustrating the attachment of the border material with tape edge formed according to FIG. 5A to the spring set.

Alternatively, as indicated in FIGS. 4A–5B, the present invention also can be used for the formation of a foundation or mattress cap or cover 40' (FIGS. 4B and 5B). Such a cap or cover 40 generally includes a border 11 that will be attached to an inner panel 12 for application to a spring set 13 for the mattress or a foundation (box springs) 10, and which further includes a decorative bead 41 being formed therewith. In one example embodiment, illustrated in FIGS. 4A–4B, a strip of border material 11 is folded as shown in FIG. 4A to form its first or lower portion 14 with a second, upper or extended portion 16 of the border 11 being folded partially over the first or lower portion of the border to form the fold 17. Flanging material 30 is inserted between the folded portions 14, 16 of the border, with the side edge 43 of the flanging material 30 enclosed within the fold, as shown in FIGS. 4A and 5A. the border then is secured to the flange material by a line of stitching 22 that is applied along a desired location or point 42 spaced inwardly from the fold 17, i.e., approximately ¼–½ inch, up to approximately 1 inch or more from the fold 17 as desired. This application of line or lines of stitching 22 adjacent the fold, thus not only secures the flanging material to the border, and also possibly the inner panel of the mattress as shown in FIGS. 2B and 3B above, it further defines or forms the decorative bead 41 (FIGS. 4A–4B), which thus is formed from the same material as the border so as to match the border.

Figure 1A:
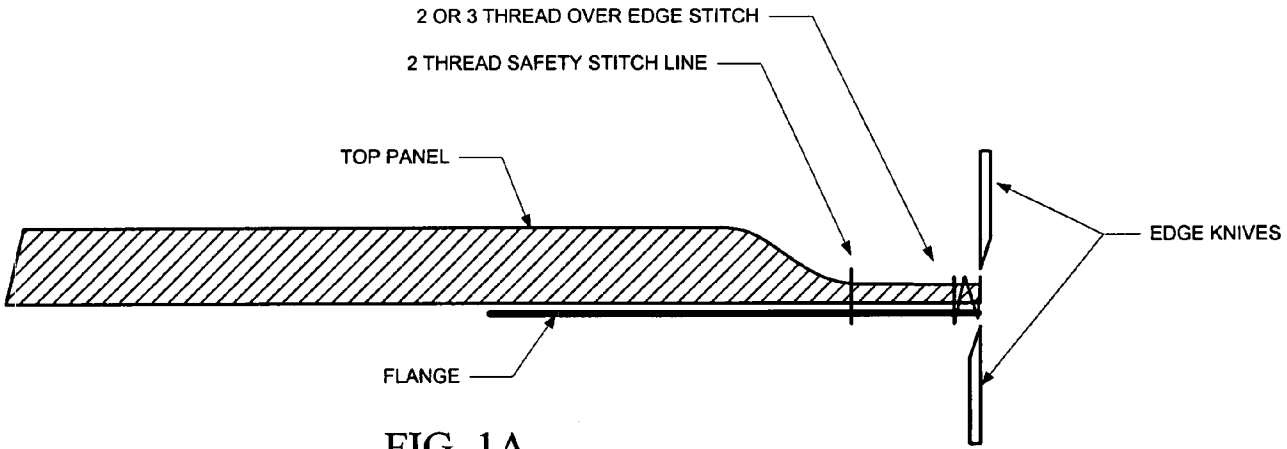
FIGS. 1A–1B are side elevational views of a conventional prior art method of forming and attaching a top panel of a mattress to a spring set.
Figure 1B:
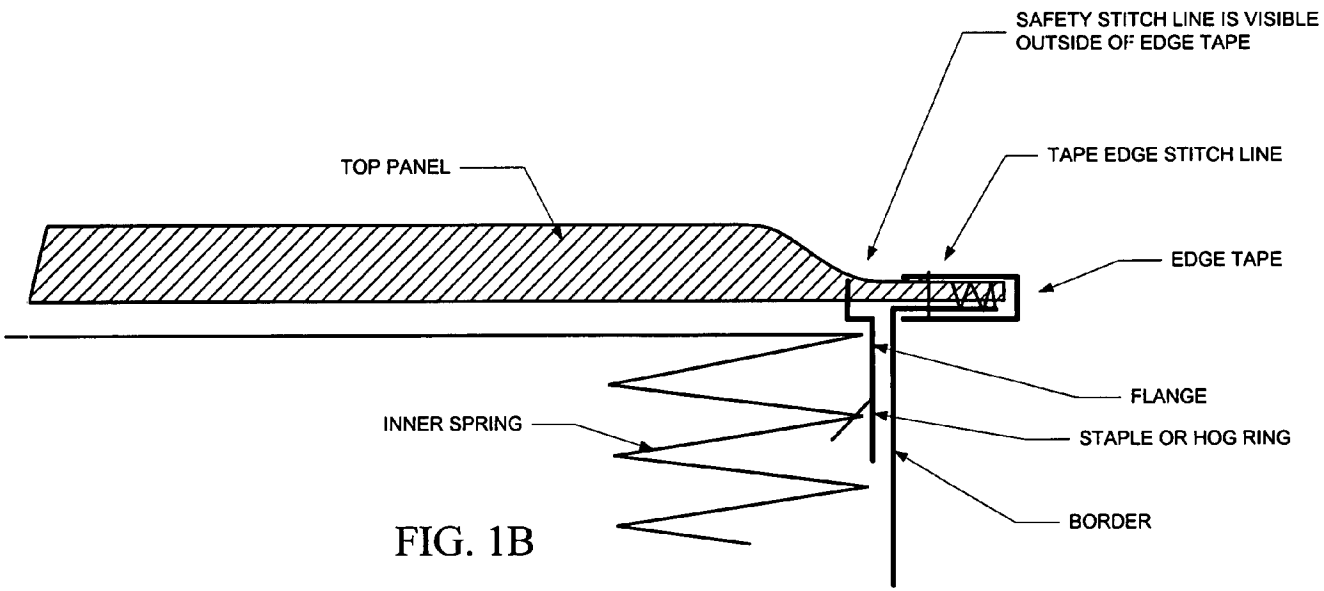

Thereafter, the sewn border 11 with flanging material 30 generally is transferred or fed directly to a ruffler workstation where the border is attached to the inner panel 12 for a mattress or foundation as illustrated in FIG. 4B. The extended or second, upper portion 16 of the border 11 is thus attached to the inner panel 12, and at the same time is ruffled or pleated about the corners thereof. Thereafter, the ruffled border with the inner panel attached thereto will be attached to the foundation or an inner spring 32 (FIG. 4B) of the spring set 24 for a mattress by the flanging material 30, such as by being hog ringed or stapled (shown at 31 in FIGS. 4B and 5B) to an inner spring 32. Once attached, as shown in FIGS. 4B and 5B, the border material is placed in an overlying relationship extending along the sides of the spring set or foundation, with the decorative bead 41 extending about the corners and upper edges of the border. In the embodiment shown in FIGS. 1A–1C, the bead 41 is a "self-taped bead" in which the decorative bead matches the material of the border as the decorative bead is formed from the border material itself. The resultant mattress or foundation thus is provided with a decorative, finished appearance having a decorative bead extending around its upper peripheral edge without requiring a separate tape edge to be applied thereto in a subsequent, downstream sewing operation.

FIGS. 5A–5B illustrate an additional alternatively for the present invention forming a foundation or mattress cap 40 having a decorative bead 41. In this embodiment, as with the embodiment shown in FIGS. 4A–4B, the border material 11 (FIGS. 5A–5B) is folded and a flanging material 30 is inserted between a second, upper or extended potion 16 of the border 11 and a first, lower, or body portion 14 thereof, with the side edge 43 of the flanging material extending into the fold 17 of the border. A binding tape 44 is then overlaid or placed about the fold 17, as indicated in FIG. 5A, and is attached thereto by a line, or lines of stitching 22 spaced inwardly from the fold. As a result, the flanging material 30 is seamed and attached within the folded portions 14/16 of the border 11 as shown in FIG. 5A as the tape 44 is secured thereto in a single sewing operation, which can be performed at a border sewing station without requiring the use of a tape edge applicator station. The binding tape typically will be a tape edge material that substantially matches other tape edge materials applied about other seams between the mattress or foundation components to which the foundation components to which the foundation or mattress cap or cover 40 thus formed is applied, or could include additional binding materials as desired, and forms or defines the decorative bead 41 of the mattress/foundation cap or cover 40.

As indicated in FIG. 5B, after the border 11 has been attached to the flanging material 30 and the binding tape 44 applied over the fold 17 thereof, the folded portion of the border material is attached to the inner panel 12 for the mattress or foundation to form the foundation or mattress cover or cap 40. As with the embodiment of FIGS. 4A–5B, the border material generally will be attached to the inner panel at a border sewing station, such as an Atlanta Attachment Company. Inc. Model 1349, One Piece Border Workstation (not shown), with a series of ruffles or pleats 30 typically being formed therein so as to provide it with ruffled, smooth, or rounded corners as indicated in FIG. 6B. Alternatively, the border and flanging material can be attached using a continental border machine, such as an Atlanta Attachment model 3200 Continental Border Machine (not shown), which forms a mattress border for a desired sized mattress or foundation having mitered corners formed therein, after which, the mitered border then will sewn to an inner panel for a mattress or foundation to form the foundation or mattress cap having a bead about an upper edge of the border and with mitered corners. Thereafter, the cap or cover 40 (FIG. 5B) is applied to a foundation or spring set for a mattress by the attachment of the flanging material 30 to an inner spring 32 or other portion of the foundation such as by a hog ring or stapling 31. As a result, once applied to the foundation or mattress spring set, the mattress is provided with a pre-taped bead 41 or upper edge that matches the tape edge(s) applied to the other seams of the mattress or foundation.

FIGS. 7A–9B illustrate various further alternative embodiments of the method of forming a mattress 100 (FIGS. 7B, 8B and 9B) according to the present invention. In a first embodiment, illustrated generally in FIGS. 7A–7B, a flanging material 101 is attached to a top panel 102 for the mattress 100, which is shown as a pillowtop that generally will include a foam or cushion material 103 sandwiched between a top fabric layer 104 and a bottom layer 106 typically formed from a woven or non-woven material similar to that of the flanging material. In this embodiment of the method of the present invention, a chain stitch machine generally is used, for example, a heavy duty Atlanta Attachment 401 type chain stitch machine with a walking foot or top feed system (not shown), such as disclosed and claimed in Applicant's co-pending U.S. patent application Ser. No. 10/817,020, filed Apr. 2, 2004, the disclosure of which is incorporated herein by reference in its entirety, as opposed to an over-edge stitching machine followed by a safety stitch applicator or station. The chain stitch machine generally will include three needles and edge trimmer knives 107 that trim the edges of the panel and flanging material to ensure that the sewn edges of the top panel and flanging material will be matched and even. The needles of the chain stitch machine further generally will apply three rows or stitch lines 108, 108' and 108" of chain stitches 109 at spaced locations from the peripheral, side edges 111, 112 of the top panel and flanging material respectively.

Figure 7A:
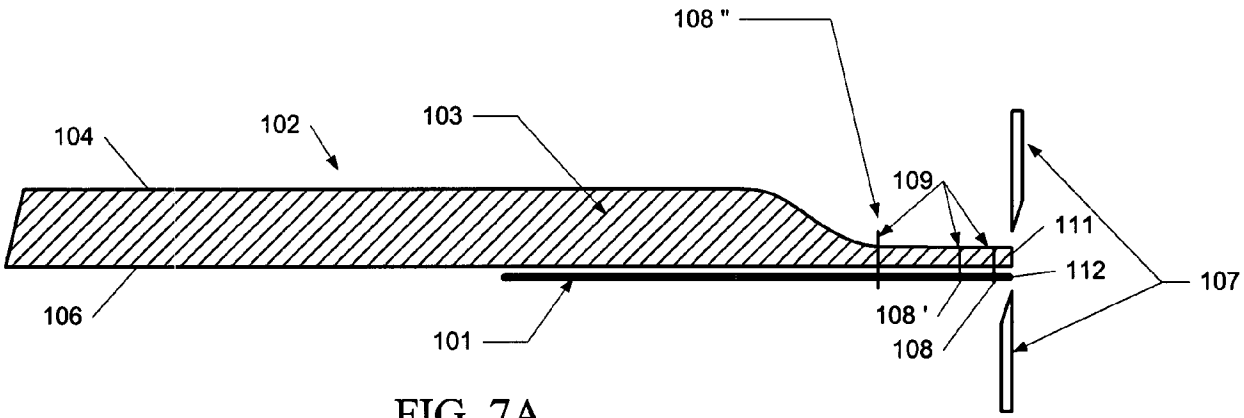
FIGS. 7A–7B illustrate yet another example embodiment of the method of the present invention for forming a pillowtop mattress

As indicated in FIG. 7A, the first two stitch lines 108 and 108' are typically spaced approximately ⅛–¼ inch from the edge of the top panel, although other spacings also can be used as needed. The third line of stitching 108" typically is applied approximately ¾-1 inch from the edge of the top panel in order to help further secure the flanging material thereto. The use of the heavy-duty chain stitch machine with a walking foot or top feed system helps reduce the amount of pressure that must be continuously applied by the presser foot to crush down the cushioning or foam material of the top panel during sewing. Consequently, this enables faster sewing and production rates for attaching the flanging material to the top panel of the mattress.

Figure 7B:
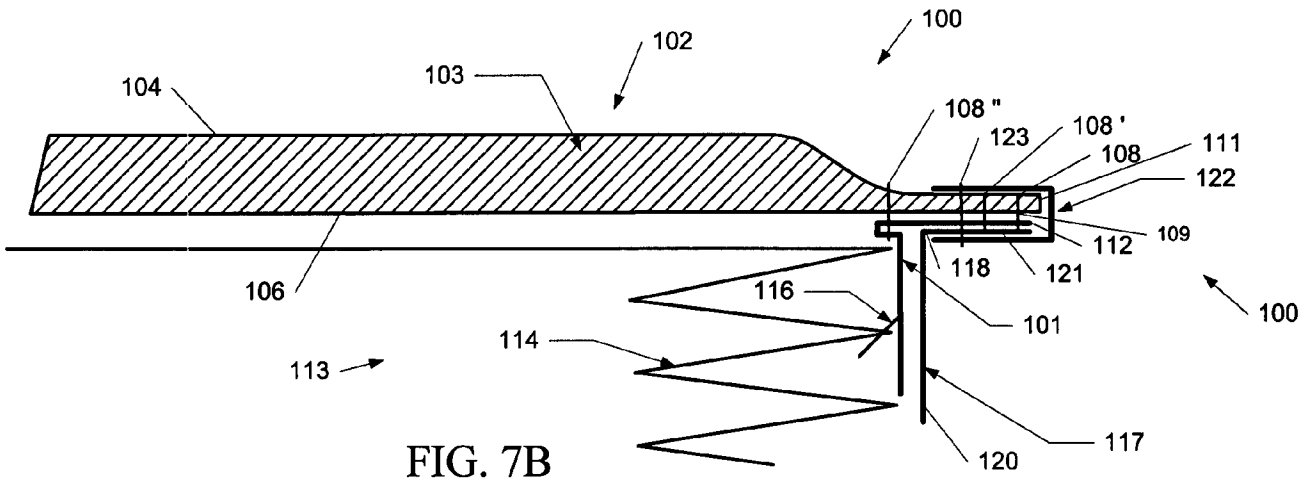

Thereafter, the top panel 102 of the mattress 100 can be applied over a spring set 113 for the mattress, with the flanging material 101 being pulled down adjacent the sides of the spring set. The flanging material 101 generally is attached to an inner spring 114 of the spring set by a staple or hog ring as indicated at 116 of FIG. 7B. Still further, a border 117 will be applied along the side edges of the spring set of the mattress, with the border 117 generally folded at 118, so as to define a first or lower portion 120, and a second, extended or upper portion 121 of the border material that will be applied against the bottom layer 106 of the top panel and flanging material and secured thereto with a tape edge 122. The tape edge generally will include an edge binding tape folded about and covering the outside edges of the plies or layers of material of the top panel and flanging material, respectively, and the border 117, and is sewn thereto along a line of stitching 123 spaced inwardly from the side edges 111 and 112 of the top panel and border as illustrated in FIG. 7B. Alternatively, the border can be attached to the top panel and flanging material in the same sewing operation per the method discussed above with respect to FIGS. 2A–6B to form a mattress cover or cap for application to the spring set.

Figure 8A:
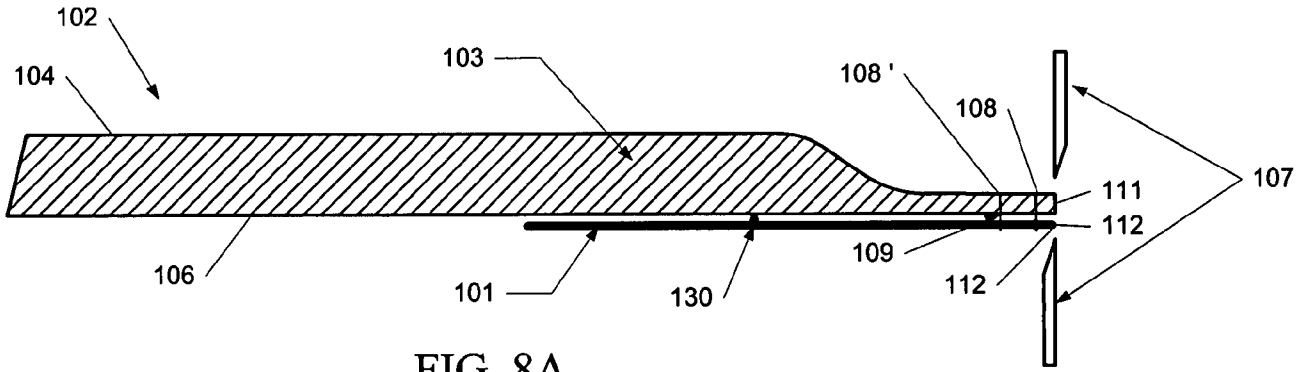
FIGS. 8A–8B illustrate a further example embodiment of the method of the present invention for forming a pillowtop mattress.
Figure 8B:
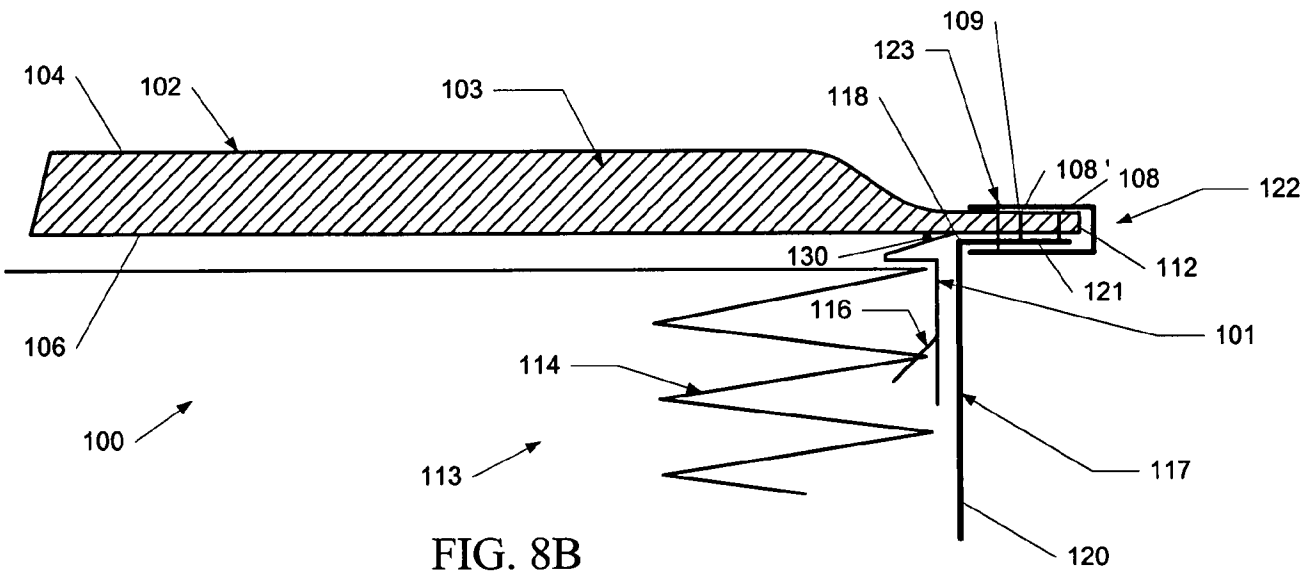

In another alternative embodiment of the method of the present invention illustrated in FIGS. 8A and 8B, a chain stitch machine, such as a heavy duty 401 type chain stitch machine, as discussed with reference to FIGS. 7A and 7B, again is used, but with the left hand or innermost needle of the chain stitch machine being removed. In this embodiment, as indicated in FIG. 8A, a bead or line of glue 130 will be applied between the flanging material 101 and the bottom layer 106 of the top panel 102 in place of the innermost stitch line 108" indicated in FIG. 7A. Typically, the bottom layer of the top panel of the mattress is formed from a material that is similar to the flanging material and thus the glue bead 130 (FIGS. 8A–8B) will serve to bond the flanging material to the bottom layer of the top panel as needed to help hold the flanging material to the bottom layer of the top panel. The use of such a glue bead 130 also eliminates the additional seam from the top panel of the mattress formed by the innermost stitch line 108", as shown in FIG. 7A. The elimination of this seam accordingly helps provide the top panel of the mattress with a smooth, plain finished appearance after the edges of the top panel have been tape edged.

As discussed with respect to FIG. 7A, the chain stitch machine will apply two lines 108, 108' of chain stitches 109 (FIG. 8A) spaced slightly inwardly from the distal side edges 111 and 112 of the top panel 102 and flanging material 101 so as to attach or secure the flanging material to the top panel of the mattress. At the same time, edge trimmer knives 107 will trim the side edges of the flanging material and top panel so as to ensure that the side edges of the top panel and flanging material will be substantially matched. Thereafter, as indicated in FIG. 8B, the top panel with the flanging material applied thereto will be placed on a spring set 113 for the mattress 100, with the flanging material being pulled down along a side surface of a spring set 113 and attached to an inner spring 114 by being stapled or hog ringed 116 to the spring. The border material 117 can then be applied along the side surfaces of the spring set, with its first, lower portion extending along the spring set and the second extended or upper portion 121 of the border being folded over and tape edged 122 about the side edges of the top panel and flanging material, as shown in FIG. 8B. It is also possible to attach the border to the top panel and flanging material in the same sewing operation as discussed above, to form a cap or cover for application to the spring set.

Figure 9A:
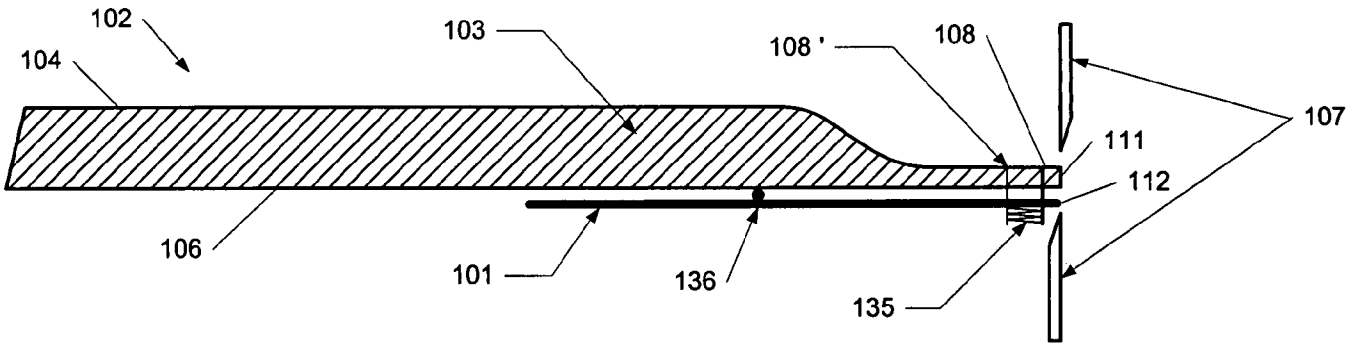
FIGS. 9A–9B illustrate still a further example embodiment of the method of the present invention for forming a pillowtop mattress.
Figure 9B:
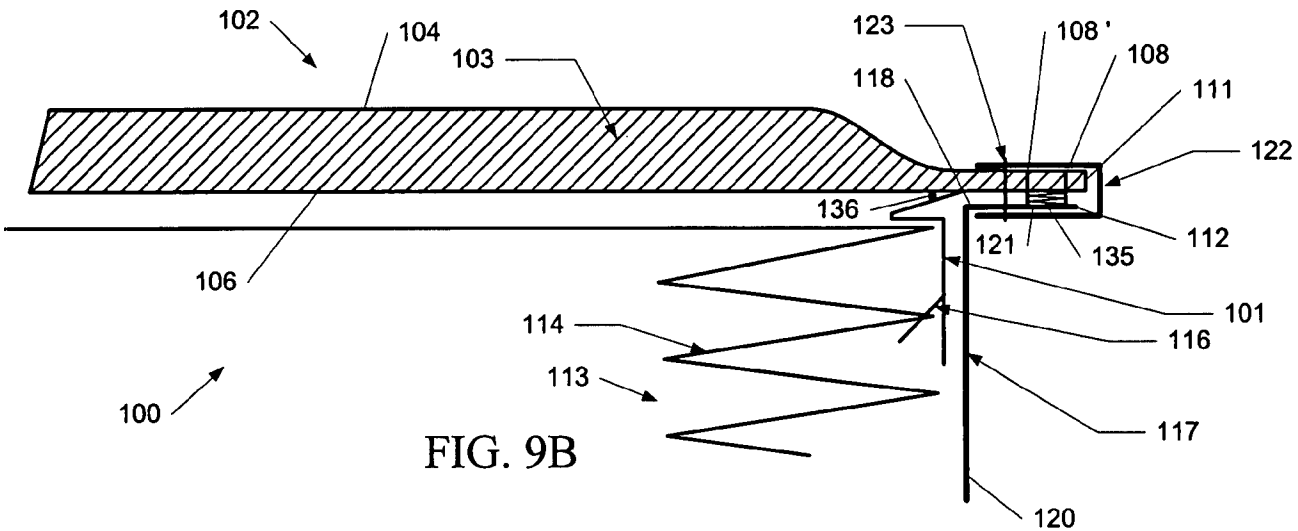

Still a further example embodiment of the present invention is illustrated in FIGS. 9A–9B. In this embodiment, the chain stitch machine is replaced with a two-needle cover stitch machine, which applies top and bottom NDL cover stitches 135 along the top and bottom layers 104, 106 of the top panel 102 to secure the flanging material 101 thereto, although for clarity sake, only the bottom cover stitch 135 is shown in FIG. 9A. In addition, the right hand or outermost needle can be positioned so as to sew at or slightly off the side edges of the top panel and flanging material as they are trimmed by the edge trimmer knives so as to apply a cover stitch over the edges of the top panel and flanging material for binding the top panel and flanging material together. Still further, as illustrated in FIG. 9A, a bead or line of 136 glue can be applied inwardly of the edges of the top panel and flanging material in order to help secure the top panel and flanging material. As discussed above, the additional seam, such as formed by the innermost line of stitching shown in FIG. 7A, is thus eliminated so as to leave a substantially smooth, plain appearance.

Thereafter, as indicated in FIG. 9B, the top panel will be applied over the spring set for the mattress, with the flanging material being pulled down along adjacent an outer spring of the spring set and attached thereto by a staple or hog ring. A border material can be pre-applied thereto to form a cap or cover that will be attached to the spring set, or can be or applied along the side surface of the spring set with the upper edge of the border material being folded over and secured to the side edge of the top panel by the application of the tape edge as shown in FIG. 9B.

It will be further understood by those skilled in the art that while the foregoing has been disclosed above with respect to preferred embodiments or features, various additions, changes, and modifications can be made to the foregoing invention without departing from the spirit and scope of thereof.

What is claimed is:

1. A method of forming a mattress, comprising:

feeding a length of border material along a path;

forming a fold along the border material by folding a sufficient amount of border material to form an attachment gusset for a pillowtop mattress and sewing a flanging material to the border material, so as to define a first border portion and a second border portion with the flanging material attached thereto;

attaching a panel along the border material to form a mattress cover; and placing the mattress cover over a spring set for the mattress and attaching the flanging material to the spring set to secure the mattress cover to the spring set.

2. The method of claim 1 and further comprising attaching a pillowtop to the attachment gusset.

3. The method of claim 1 and wherein sewing a flanging material to the border material comprises placing the flanging material within the fold, between the first and second border portions and applying a line of stitching adjacent the fold.

4. The method of claim 3 and further comprising applying a tape over the fold prior to applying the line of stitching to form a decorative bead along the mattress.

5. The method of claim 1 and wherein sewing a flanging material to the border material comprises placing the flanging material between the first border portion and the panel and applying a line of stitching adjacent the fold to attach the panel and flanging material to the border.

6. The method of claim 1 and wherein sewing a flanging material to the border material comprises placing the flanging material along the first border portion, placing the panel along the second border portion, and applying a line of stitching adjacent the fold to attach the panel and flanging material to the border.

7. The method of claim 1 and wherein forming the fold and sewing the flanging material comprises applying a line of stitching at a location spaced inwardly from the fold to secure the flanging material and to define a decorative bead between the first and second border portions.

8. The method of claim 1 and wherein attaching the border material to the panel includes ruffling the border material as the border material is attached to the panel.

9. The method of claim 1 and wherein attaching the border material to the panel includes forming mitered corners in the border material as the border material is attached to the panel.

10. A mattress cover adapted to be received over a mattress, comprising:

a border having a fold defining a first portion and a second, extended portion, integrally formed therewith, a mattress panel attached to at least one of said first and second border portions at a point of attachment;

a flanging material attached to said mattress panel with a series of three spaced lines of chain stitches to complete the cover; and means for attaching the mattress cover to the mattress.

11. The mattress cover of claim 10 and wherein said mattress panel comprises a pillowtop attached to said extended portion of said border.

12. The mattress cover of claim 10 and further comprising a tape applied over said point of attachment between said panel and at least one of said first and second border portions.

13. The mattress cover of claim 10 and further comprising a line of stitching applied at a location spaced from said fold to define a decorative bead.

14. The mattress cover of claim 10 and wherein said flanging material is attached to said mattress panel by a bead of glue and one or more lines of stitching adjacent side edges of said mattress panel and flanging material.

15. The mattress cover of claim 14 and wherein said lines of stitching comprise spaced lines of top and bottom cover stitches.

16. A method of forming a mattress, comprising:

attaching a flanging material to a top panel of the mattress by applying a series of chain stitches at spaced locations from a side edge of the top panel;

attaching the flanging material to a spring of a spring set of the mattress to secure the top panel to the spring set; and applying a border material adjacent the spring set of the mattress.

17. The method of claim 16 and further comprising forming a fold in a border material to define first and second border portions, and attaching the second border portion to a side edge of the top panel.

18. The method of claim 17 and further comprising applying a tape edge over the side edges of the top panel and the second border portion.

19. A method of forming a mattress, comprising:

attaching a top panel of the mattress to a flanging material by applying lines of stitching adjacent a side edge of the top panel;

applying a bead of glue between the flanging material and a bottom layer of the top panel at a point spaced inwardly from the lines of stitching;

applying the top panel to a spring set for the mattress; and securing a border material to the side edge of the top panel with a tape edge.

20. A method of forming a mattress with a decorative bead, comprising:

feeding a supply of border material along a processing path;

folding the border material and inserting a flanging material within a fold of the border material;

applying a binding tape about the fold of the border material;

applying a line of stitching at a location spaced from the fold of the border material to attach the flange material to the border material and define the bead;

attaching the border material to a panel; and attaching the border material and panel to a spring set or foundation.

21. The method of claim 20 and wherein attaching the border material to the panel includes ruffling the border material as the border material is attached to the panel.

22. The method of claim 20 and wherein attaching the border material to the panel includes forming mitered corners in the border material as the border material is attached to the panel.

23. A method of forming a mattress, comprising:

feeding a length of border material along a path;

forming a fold along the border material and sewing a flanging material to the border material, so as to define a first border portion and a second border portion with the flanging material attached thereto;

attaching a panel along the border material and ruffling the border material as it is joined to the panel to form a mattress cover; and placing the mattress cover over a spring set for the mattress and attaching the flanging material to the spring set to secure the mattress cover to the spring set.

* * * * *